United States Patent [19]

Deubler et al.

[11] Patent Number: 5,058,270

[45] Date of Patent: Oct. 22, 1991

[54] DRY SHAVING APPARATUS INTERRUPTING MOTOR CIRCUIT AS SHEAR FOIL AND SHAVING HEAD ARE EXPOSED

[75] Inventors: Hans Deubler; Ingo Müller; Arno Wolfger, all of Kalgenfurt, Austria

[73] Assignee: U.S. Philips Corp., New York, N.Y.

[21] Appl. No.: 598,475

[22] Filed: Oct. 15, 1990

[30] Foreign Application Priority Data

Oct. 13, 1989 [AT] Austria ..... 2365/89

[51] Int. Cl.[5] ..... B26B 19/38; B26B 19/02

[52] U.S. Cl. ..... 30/34.05; 30/43.92

[58] Field of Search ..... 30/34.05, 34.1, 43.91, 30/43.92

[56] References Cited

U.S. PATENT DOCUMENTS

| | | | |
|---|---|---|---|
| 4,862,589 | 9/1989 | Wolfger | 30/43.92 |
| 4,891,880 | 1/1990 | Poganitsch | 30/43.92 |
| 4,901,436 | 2/1990 | Gosch et al. | 30/43.92 |
| 4,969,266 | 11/1990 | Poganitsch | 30/34.05 |

*Primary Examiner*—Douglas D. Watts
*Assistant Examiner*—Paul M. Heyrana, Sr.
*Attorney, Agent, or Firm*—Ernestine C. Bartlett

[57] ABSTRACT

In a dry shaving apparatus comprising a shaving head frame (5) detachably fixed to the basic apparatus (1) by at least one resilient latch element (2, 3) and carrying an apertured shear foil (4) and a slidable shutter (6), which serves to optionally cover or expose the apertured shear foil and which, when it is displaced in the direction away from the apertured shear foil, is displaceable into a switching-on position and subsequently into a further position, in which the motor current circuit is interrupted, it is ensured that the latch element cooperating with the shaving head frame is connected to a slide (17, 18), which is displaceable parallel to the direction of displacement of the shutter and cooperates with a spring (22, 23), which attempts to pass the slide and the latch element to the latched position holding the shaving head frame and the shutter, when it is displaced from the switching-on position to the further position, can be positively coupled after the interruption of the motor current circuit with the slide and the slide can be taken along by the shutter, the latch element being moved out of the latched position holding the shaving head frame and the shaving head frame being disengaged.

20 Claims, 6 Drawing Sheets

DRY SHAVING APPARATUS INTERRUPTING MOTOR CIRCUIT AS SHEAR FOIL AND SHAVING HEAD ARE EXPOSED

BACKGROUND OF THE INVENTION

The present invention relates to dry shaving apparatus including a shaving head frame detachably fixed to the basic apparatus by at least one resilient latch element and carrying an apertured shear foil and a slidable shutter, which serves to optionally cover or expose the apertured shear foil and which, when it is displaced in the direction away from the apertured shear foil, can be displaced into a switching-on position latched by a latch, in which the apertured shear foil is exposed for shaving and the motor current circuit for the drive of the dry shaving apparatus is closed, which shutter, when it is further displaced in the direction away from the apertured shear foil, can be displaced from the switching-on position to a further position, in which the apertured shear foil and the shaving head frame are exposed by the shutter and the motor current circuit for the drive of the dry shaving apparatus is interrupted.

Such dry shaving apparatus is described in European Patent document EP-OS 0 290 073, in the embodiment of FIGS. 7, 8 and 9. In this known dry shaving apparatus, the further position for the slidable shutter is latched, like the switching-on position, by a latch. In this further position of the shutter, in which the dry shaving apparatus is not ready for use due to the interrupted motor current circuit, but both the apertured shear foil and the shaving head frame are exposed by the shutter, the shaving head frame can be removed without hindrance by the shutter from the basic apparatus, for example, for cleaning purposes or for exchange of the apertured shear foil. Since the shaving head frame is detachably fixed usually by means of at least one resilient latch element to the basic apparatus, in the further position of the shutter the shaving head frame must therefore be disengaged from the latch element cooperating therewith, for example by depression of a pushbutton displacing the latch element, which therefore requires a specific operation.

An object of the present invention is to further improve or simplify the manipulation of a dry shaving apparatus of the foregoing described type.

According to the invention, it is ensured for this purpose that the latch element cooperating with the shaving head frame is connected to a slide, which is displaceable parallel to the direction of displacement of the shutter and which cooperates with a spring, which attempts to pass the slide and the latch element connected to it to the latched position in which the shaving head frame is held and that the shutter, when it is displaced from the switching-on position to the further position, after it has left the switching-on position and after the motor current circuit has been interrupted, can be positively coupled with the slide and the slide can be taken along against the action of the spring cooperating with it by the shutter, the latch element being moved out of the latched position holding the shaving head frame and the shaving head frame being disengaged. In this manner, it is achieved that, when the shutter is displaced to the further position, the latch element automatically disengages the shaving head frame, as a result of which a specific operation is no longer required to permit in this further position of the shutter of simply removing by hand the shaving head frame from the basic apparatus. When the dry shaving apparatus is constructed so that the lower blade, which is usually pressed resiliently against the apertured shear foil and can be driven, is arranged not at the shaving head frame, but, as is common practice, at the basic apparatus itself, the shaving head frame, which in such a case carries alone the apertured shear foil, after it has been exposed, is pushed away from the basic apparatus or lifted therefrom by the latch element under the resilient force acting upon the apertured shear foil from the lower blade, which makes it still simpler to remove it by hand. When the shutter leaves the further position in the direction towards the apertured shear foil, the spring cooperating with the slide ensures that the slide and the shutter, due to the fact that they are positively coupled with each other, are commonly displaced in the direction towards the apertured shear foil to a position, in which the latch element again has reached the latched position, the motor current circuit then being interrupted. This can take place independently of the fact whether the shaving head frame has been brought at this instant into a position at the basic apparatus in which it can be held by the latch element, or whether it is still in the position in which it is removed from the basic apparatus. In case the shaving head frame has already been brought again by hand into the position provided for it at the basic apparatus, the latch element immediately engages in the latch at the shaving head frame and holds it at the basic apparatus. Otherwise, when the shaving head frame is still in a position in which it is disengaged from the basic apparatus and the latch element has already reached again the latched position, the shaving head frame can then be simply snapped into the elastically resilient latch element to arrange it at the basic apparatus, as a result of which it is held at the basic apparatus. As is apparent, in this manner, altogether a very simple operation of the dry shaving apparatus is obtained.

It has proved to be constructively very simple when the slide is constituted by a blade spring. In this manner, due to the construction of the slide as a spring the resilience required for the latch element is immediately obtained.

In this connection, it has further proved to be advantageous when the blade spring has at its end facing the shaving head frame a rectangularly bent hook-shaped part, which constitutes the latch element. As a result, the construction is further simplified because the slide and the resilient latch element constitute a part made in one piece.

As in the known dry shaving apparatus mentioned in the opening paragraph, for example the further position of the shutter as well as its switching-on position can be fixed by a latch element. As a result, it is ensured that, when the shaving head frame is removed from the basic apparatus, the motor current circuit for the drive of the dry shaving apparatus cannot be unintentionally closed. With a view to a further improvement of the operability of the dry shaving apparatus, however, it can be found to be advantageous when the further position of the shutter is not fixed, the shutter being displaceable from the further position together with the slide under the action of the spring cooperating with the slide in the direction towards the apertured shear foil until the latched position of the latch element connected to the slide is attained and the motor current circuit for the drive of the dry shaving apparatus remaining interrupted upon a further displacement of the shutter towards the apertured shear foil by means of a change-over switch until the shutter after a displacement beyond the switching-on position is again displaced in the direction away from the apertured shear foil into the switching-on position. In this embodiment, the shutter is therefore brought into the further position and is held therein by hand, in which position the shaving head frame can then be simply removed from the basic apparatus because it is held no longer by the latch element, after which the shutter must be released in order to return together with the slide and the latch element into a position in which the latch element is again in the latched position. As soon as the latch element has reached the latched position, again there is a possibility to arrange the shaving head frame at the basic apparatus in that it is snapped into the elastically resilient latch element and is thus held at the basic apparatus. In order that, also when in the present case the shaving head frame is removed from the basic apparatus, the motor current circuit for the drive of the dry shaving apparatus is prevented from being unintentionally switched on, it is further ensured that by means of the change-over switch the motor current circuit for the drive of the dry shaving apparatus remains interrupted until the shutter after a further displacement in the direction towards the apertured shear foil and beyond the switching-on position is displaced again in the direction away from the apertured shear foil into the switching-on position. It has been found that such an operation of the dry shaving apparatus can be carried out in a simple manner, it being ensured that, when the shaving head frame is removed from the basic apparatus, the motor current circuit for the drive of the dry shaving apparatus remains interrupted until the shutter is intentionally displaced in the direction away from the apertured shear foil into the switching-on position.

In this respect, it has further proved to be advantageous when there is provided between the switching-on position fixed by a latch and the unfixed further position of the shutter an additional position for the shutter which is fixed by a further latch and in which the apertured shear foil and the shaving head frame are exposed by the shutter and the motor current circuit for the drive of the dry shaving apparatus is interrupted, while the further latch is constituted on the one hand, viewed in the direction of displacement of the shutter away from the apertured shear foil, by the slide acted upon by the spring when the latch element is in the latched position and on the other hand, viewed in the direction of displacement of the shutter towards the apertured shear foil, by at least one fixed abutment. When for the shutter such an additional position is provided, which is fixed by a further specifically constructed latch, a defined position of the shutter is obtained, in which the motor current circuit for the drive of the dry shaving apparatus is interrupted and, when the latch element is in the latched position, the shutter is situated immediately before the position in which it is operatively positively coupled with the slide or immediately behind the position in which the shutter is operatively decoupled from the slide, depending upon the direction of displacement in which the shutter reaches this additional position, i.e. either from the switching-on position or from the further position. As a result, on the one hand a fixed starting point is obtained to be able to remove during a further process the shaving head frame from the basic apparatus, which is made possible by displacing the shutter into the further position, while on the other hand the shutter and the slide return, after they have left the further position, to a defined position corresponding to the aforementioned starting point, in which the latch element is in the latched position so that the shaving head frame can be arranged in a precise manner at the basic apparatus.

It has further proved to be advantageous when between the outer side of the shaving head frame and the basic apparatus at least one straight line guiding is provided, which defines the direction of the movement of removal of the shaving head frame from the basic apparatus. Thus, both the removal of the shaving head frame from the basic apparatus and the placement of the shaving head frame on the basic apparatus are effected in a very precise and reliable manner.

It has also proved to be advantageous in a dry shaving apparatus, in which the apertured shear foil cooperates with a lower blade, which is arranged at the basic apparatus and is resiliently pressed against the apertured shear foil, when between the shaving head frame and the basic apparatus elastically resilient abutment stops are provided, which cooperate with each other in the direction of the movement of removal of the shaving head frame from the basic apparatus and which limit the movement of lifting the shaving head frame from the basic apparatus after disengagement of the shaving head frame by the latch element under the action of the spring-loaded lower blade. In this manner, when the shaving head frame is disengaged by the latch element, the shaving head frame cannot unintentionally fall downwards from the basic apparatus, which could occur under the resilient force acting from the lower blade upon the apertured shear foil. Due to the elastically resilient construction of the abutment stops, the shaving head frame can then be removed without great effort by hand, while overcoming the abutment stops, from the basic apparatus in a simple and reliable manner.

In a dry shaving apparatus, in which both a straight line guiding as mentioned above is provided and the aforementioned abutment stops are used, it has further proved to be advantageous when the abutment stops are provided at the area of the straight line guiding. In this manner, a very simple and space-saving construction is obtained.

BRIEF DESCRIPTION OF THE DRAWING

In order that the invention may be readily carried out, it will now be described more fully, by way of example, with reference to the drawing figures, which show two illustrative embodiments of the invention, to which it is not limited, however.

FIG. 4 shows the position of the shutter in which it covers the apertured shear foil. FIG. 5 shows the position in which the shutter starts, when being displaced away from the apertured shear foil, snapping into a switching slide. FIG. 6 shows the position in which the shutter has fully snapped into the switching slide. FIG. 7 shows the switching-on position of the shutter fixed by a latch, in which the apertured shear foil is exposed for shaving and the motor current circuit for the drive, of the dry shaving apparatus is closed. FIG. 8 shows an additional position of the shutter fixed by a further latch, in which it is situated immediately before the position in which it is operatively positively coupled with the slides carrying the latch elements. FIG. 9 shows the unfixed further position of the shutter, in which the latch elements are moved out of their latched position and the shaving head frame exposed by the shutter, is disengaged by these elements. FIG. 10 again shows the additional position of the shutter after it has left the further position in the direction towards the apertured shear foil, and FIG. 11 shows the position in which the shutter, after having left the further position shown in FIG. 10, is again in the switching-on position, the motor current circuit for the drive of the dry shaving apparatus being interrupted, however.

DETAILED DESCRIPTION OF THE PREFERRED EMBODIMENT

Figure 1:
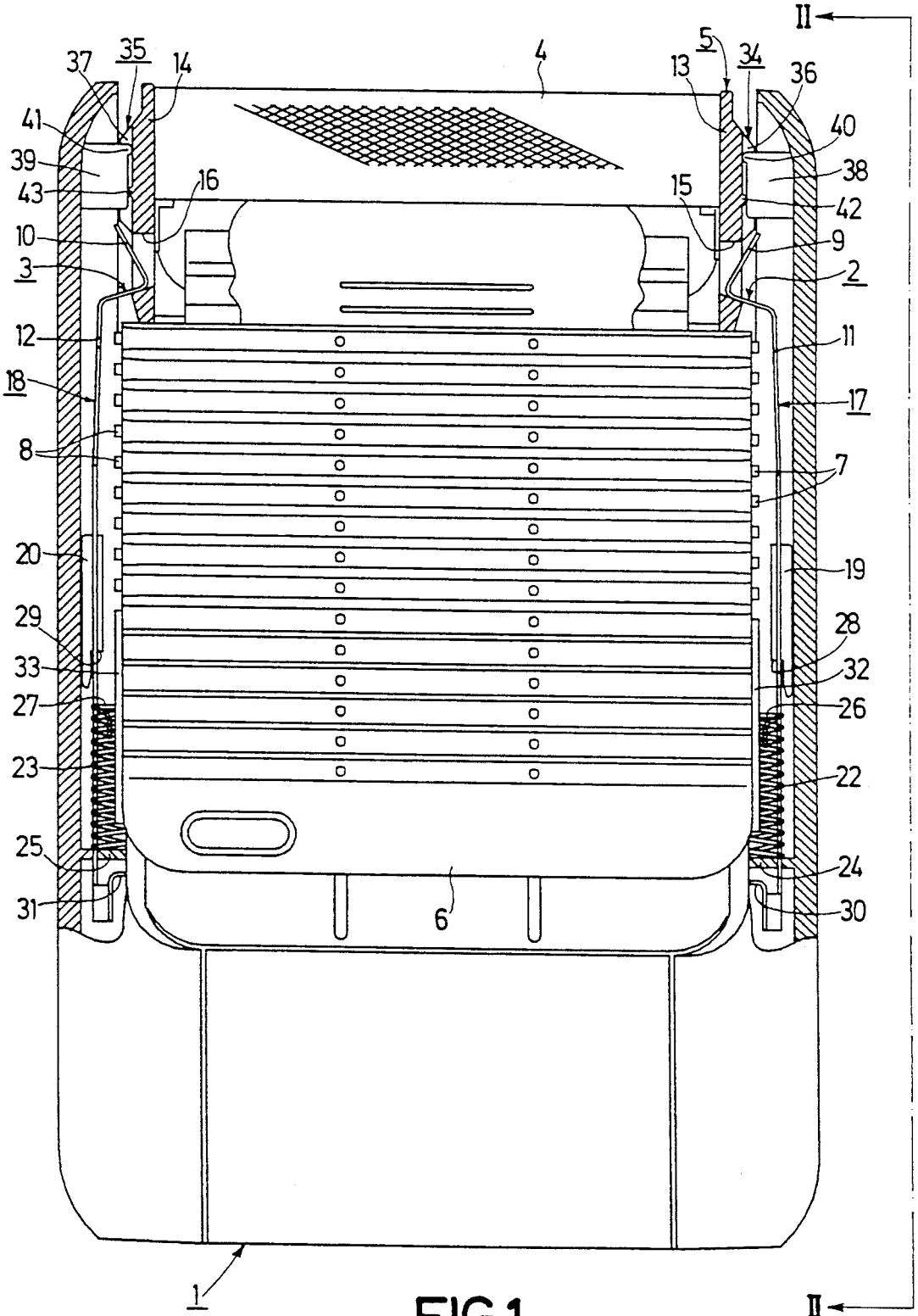
FIG. 1 shows partially in sectional view a dry shaving apparatus, in which the shaving head frame is fixed to the basic apparatus by two latch elements and which is provided with a slidable shutter for optionally covering or exposing the apertured shear foil, the shutter being shown in a position, in which the apertured shear foil is exposed for shaving.
Figure 2:
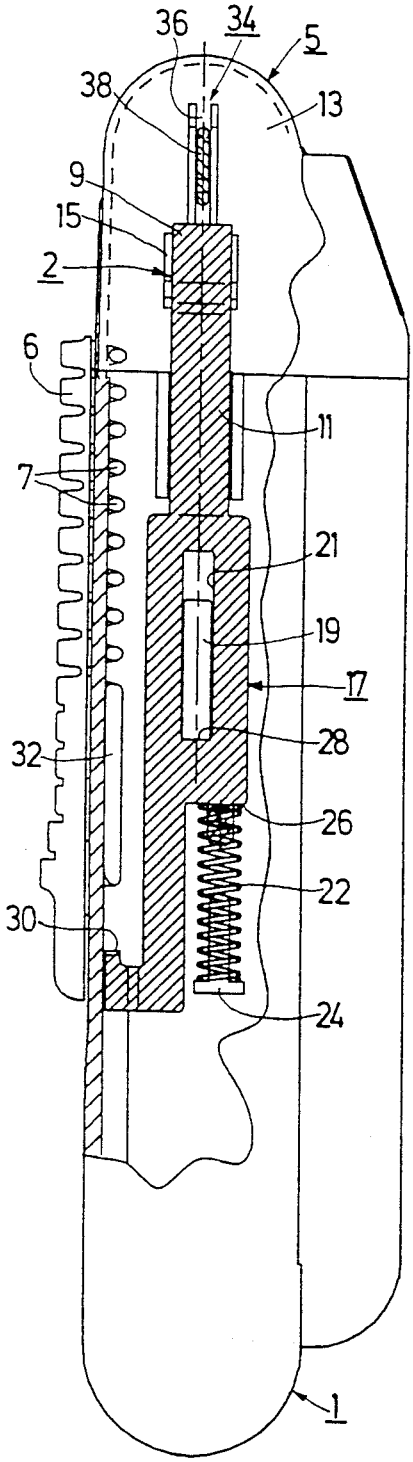
FIG. 2 shows partially in sectional view the dry shaving apparatus of FIG. 1 in a side elevation taken on the line II—II in FIG. 1.

In FIGS. 1 and 2, reference numeral 1 denotes the basic dry shaving apparatus, to which a shaving head frame 5 carrying an apertured shear foil 4 is detachably fixed by means of two resilient latch elements 2 and 3. The dry shaving apparatus is further provided with a slidable shutter 6, which serves to optionally cover or expose the apertured shear foil 4, for which purpose it is slidably guided by lateral projections 7 and 8, respectively, provided on it in grooves (not shown) provided in the basic apparatus 1. The resilient latch elements 2 and 3 holding the shaving head frame 5 at the basic apparatus 1 are constituted in the present case by the rectangularly bent ends 9 and 10, respectively, of a blade spring 11 and 12, respectively. For holding the shaving head frame 5 at the basic apparatus 1, these rectangularly bent ends 9 and 10 each engage in a recess 15 and 16, provided in the slide parts 13 and 14, respectively, of the shaving head frame 5. The blade springs 11 and 12 are in turn constructed as slides 17 and 18, respectively, which are displaceable parallel to the direction of displacement of the shutter, which is obtained in that guide edges 19 and 20, respectively, are provided at the basic apparatus 1, which edges engage in slots provided in the blade springs 11 and 12, as can be seen especially in FIG. 2, in which the slot provided in the blade spring 11 is denoted by 21. The slides 17 and 18 each cooperate with a spring 22 and 23, respectively, which attempts to pass the slides and hence the latch elements 2 and 3, respectively, connected to them to the latched position holding the shaving head frame 5, which is achieved in that the springs 22 and 23 constructed as compression springs bear with one end on projections 24 and 25, respectively, provided at the basic apparatus 1 and with their other end on rectangularly bent projections 26 and 27, respectively, provided at the blade springs 11 and 12. The latched position of the latch elements 2 and 3 is then fixed in that one end of the slots provided in the blade springs 11 and 12 engages one end 28 and 29, respectively, of the guide edges 19 and 20, as a result of which the displaceability of the slides 17 and 18 towards the shaving head frame 5 is limited. At the ends of the blade springs 11 and 12 remote from the shaving head frame 5, rectangularly bent projections 30 and 31, respectively, are provided, which lie in the path of displacement of projections 32 and 33, respectively, provided laterally at the shutter 6, as a result of which the shutter 6 during its displacement away from the apertured shear foil 5 can be positively coupled with the slides 17 and 18 in a given position in that the projections 32 and 33 engage the projections 30 and 31.

Figure 3:
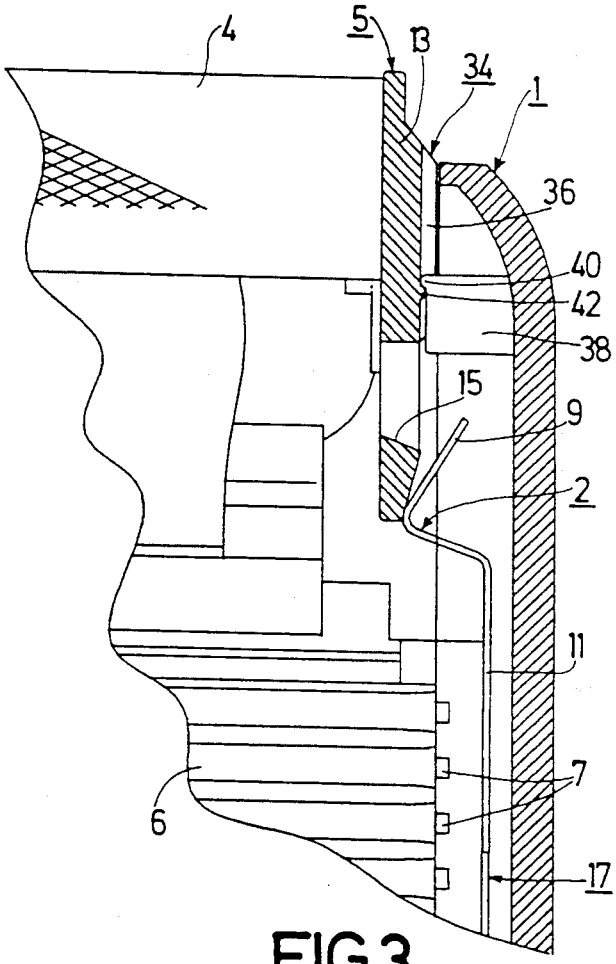
FIG. 3 shows in the manner of representation of FIG. 1 a cut-out part of the dry shaving apparatus of FIG. 1, the shutter being shown in a further position, in which the apertured shear foil and the shaving head frame are exposed by the shutter and the shaving head frame is disengaged by the latch elements moved out of the latched position.

During a subsequent further displacement of the shutter 6 away from the apertured shear foil 4, the slides 17 and 18 are taken along against the action of the springs 22 and 23 cooperating with them by the shutter, as a result of which the latch elements 2 and 3 connected to the slides are also moved out of their latched positions as a result of which the rectangularly bent ends 9 and 10 of the blade springs 11 and 12 are resiliently pulled out of the recesses 15 and 16 provided in the side parts 13 and 14 of the shaving head frame 5 and hence the shaving head frame 5 is disengaged by the latch elements 2 and 3, as shown in FIG. 3.

Of course it is not absolutely necessary that the slides 17 and 18 are constituted by blade springs, but they could also consist of rigid parts, from which the latch elements 2 and 3 are then resiliently arranged. Due to the construction chosen in the present embodiment, however, the advantage is obtained that the slides and the latch elements are constructed as parts made in one piece, while it is not necessary to take separate measures for the resilient construction of the latch elements.

After the shaving head frame 5 has been disengaged by the latch elements 2 and 3, the shaving head frame can simply be removed by hand from the basic apparatus 1. In order that such an operation of removing the shaving head frame 5 from the basic apparatus 1 and of placing it on the basic apparatus 1 is effected in a very reliable manner, two straight line guidings 34 and 35, respectively, defining the direction of movement of removal of the shaving head frame 5 from the basic apparatus 1 are provided between the outer side of the shaving head frame 5 and the basic apparatus 1. In the present case, these straight line guidings are constituted each by a guide groove 36 and 37, respectively, provided in the side parts 13 and 14 of the shaving head frame, a rib 38 and 39, respectively, provided at the basic apparatus 1 engaging in each of these grooves. Of course there are also other constructive solutions for such straight line guidings within the scope of the known prior art.

Usually, the apertured shear foil 4 cooperates with a lower blade not shown here, which is resiliently pressed against the apertured shear foil. As is common practice, such a lower blade is arranged at the basic apparatus 1. In such a case, the shaving head frame 5, after it has been disengaged by the latch elements 2 and 3, is pressed away from or lifted off the basic apparatus 1 by the lower blade resiliently against the apertured shear foil. In order to avoid having the shaving head frame 5 fall unintentionally downwards from the basic apparatus 1, elastically resilient abutment stops 40 and 41, respectively, and 42 and 43, respectively, cooperating with each other in the direction of the movement of removal of the shaving head frame from the basic apparatus are provided between the shaving head frame and the basic apparatus, which abutment stops limit the movement of lifting off the shaving head frame from the basic apparatus occurring under the action of the spring-loaded lower blade due to their mutual engagement after the shaving head frame 5 has been disengaged by the latch elements 2 and 3, as is shown in FIG. 3. In the present case, these abutment stops 40, 41 and 42, 43 are arranged at the area of the straight line guidings 34 and 35, respectively, in that on the one hand elastically resilient nap-shaped projections are provided at the ribs 38 and 39 and on the other hand similar elastically resilient nap-shaped projections are provided at the bottom of the grooves 36 and 37, as a result of which a particularly simple construction is obtained. The shaving head frame can then be removed in a simple manner by hand from the basic apparatus while overcoming the resilient abutment stops. Of course there are also further constructive possibilities for the construction of such abutment stops.

With reference to FIGS. 4 to 11, the further construction and the operation of a dry shaving apparatus of the kind described with reference to FIGS. 1 and 2 are described more fully, specific parts of the parts already mentioned being represented in these Figures in a simplified and diagrammatic form. More particularly, with reference to FIGS. 4 to 11 an embodiment for a preferred choice of the separate given positions of the shutter and the functions caused therein by the shutter as well as the switch operation for closing or interrupting the motor current circuit for the drive of the dry shaving apparatus will be described.

The operation of closing or interrupting the motor current circuit is effected by means of a switch 44, which has two resilient contact lamellae and is actuated from a switch slide 45 arranged at the basic apparatus 1 so as to be displaceable parallel to the direction of displacement of the shutter 6, for which purpose the switching slide 45 has an elastically resilient arm 46, which is provided with a switching cam 47, which projects transversely, has a rhombic cross-section and from which the two contact lamellae of the switch 44 can be caused to engage each other, which is effected during a displacement of the switching cam 47 when it cooperates with a change-over switch 48, which is fixedly arranged at the basic apparatus 1, also has a rhombic cross-section and is arranged in the path of displacement of the switching cam 47. Due to the rhombic shape of the change-over switch 48, in cooperation with the likewise rhombic switching cam 47 ascending surfaces become operative, which bring about opposite deflections of the switching cam in the two directions of movement of this cam, as will be described hereinafter.

Figure 4:
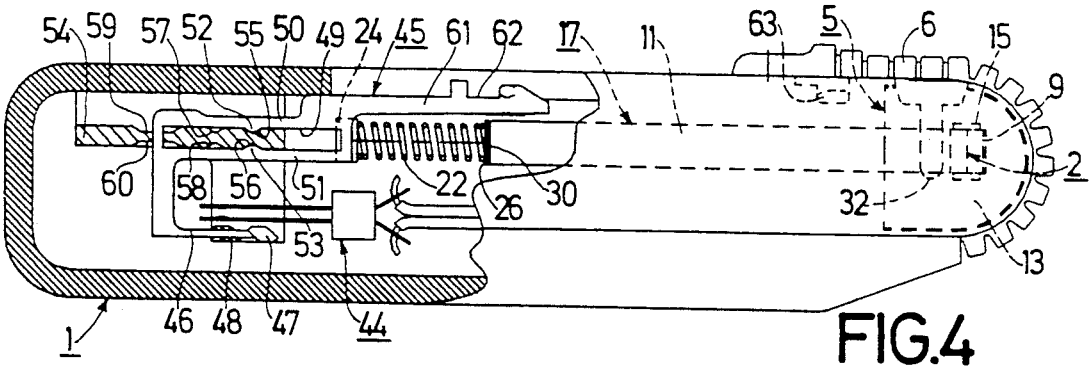
FIGS. 4 to 11 show in the manner of representation of FIG. 2, partially diagrammatically and modified with respect to details, the dry shaving apparatus of FIG. 1 when the shutter is in different positions.

The switching slide 45 is further provided with a slot 49, which is laterally limited by two elastically resilient connecting limbs 50 and 51 of the switching slide 45, at which two lateral opposite projections 52 and 53 are provided, which form a constriction in the slot 49. An edge 54 fixedly arranged at the basic apparatus 1 engages in this slot 49, which edge serves on the one hand to guide the switching slide 45 and on the other hand defines latched positions for the switching slide 45 in that it is provided at given areas in its longitudinal direction with lateral pairwise oppositely arranged notches 55, 56 and 57, 58 and with elongate depressions 59, 60, which are intended to cooperate with the projections 52 and 53 at the switching slide 45. As appears from FIG. 4, the notches 55 and 56, in which the projections 52 and 53 engage in the case of FIG. 4, define a position for the switching slide 45, in which the motor current circuit for the drive of the dry shaving apparatus is interrupted by the switch 44, because in this position of the switching slide the switching cam 47 is out of engagement with the contact lamellae of the switch 44, it being located, viewed in the direction of displacement of the shutter 6 away from the apertured shear foil, before the change-over switch 48. Moreover, the switching slide 45 has a further arm 61, whose free end is elastically resilient transversely to the direction of displacement of the shutter 6 and has a depression 62 intended to receive a coupling member 63 provided at the shutter 6, in order that the shutter 6 can be positively coupled with the switching slide 45, so that, after the coupling has been established, the switching slide 45 can be taken along by the shutter 6. FIG. 4 shows the shutter 6 in a position at the dry shaving apparatus in which it completely covers the apertured shear foil and the shaving head frame 5, the shaving head frame 5 being held at the basic apparatus 1 by the latch elements 2 and 3 being in their latched position. In this position of the shutter 6, the projections 32 and 33 provided at it, which are assumed to be in this case pin-shaped projections, are out of engagement with the projections 30 and 31 provided at the slides 17 and 18 carrying the latch elements 2 and 3 so that no positive coupling exists between the shutter 6 and the slides 17 and 18. It appears from the representation of FIG. 4 that only the foremost latch element 2 and the foremost slide 17 carrying it can be seen, while the same applies to the relevant other parts.

Figure 5:
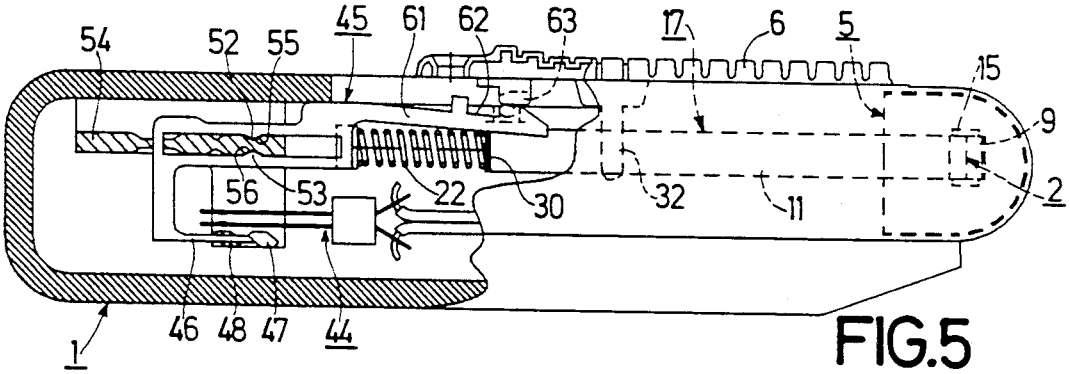
Figure 6:
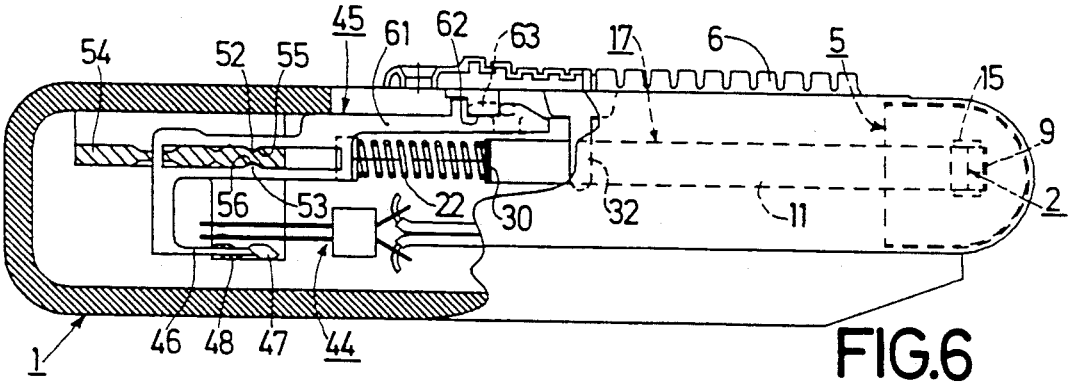

When now the shutter 6 is displaced from the position shown in FIG. 4 in the direction away from the apertured shear foil until it has attained the position shown in FIG. 5, the coupling member 63 starts snapping into the free end of the arm 61 of the switching slide 45 in that this free end is deflected transversely to the direction of displacement of the shutter. Upon a further displacement of the shutter 6 away from the apertured shear foil, the coupling member 63 provided at the shutter completely snaps into the depression 62 at the arm 61 of the switching slide 45, as shown in FIG. 6. In this manner, the shutter 6 is now positively coupled with the switching slide 45, as a result of which upon a further displacement of the shutter away from the apertured shear foil the switching slide 45 is now taken along by the shutter 6. In the positions of the shutter 6 shown in FIGS. 4, 5 and 6, the switching slide 45 is therefore in the same position, which is fixed by the cooperation of the projections 52 and 53 provided at it with the notches 55 and 56 provided at the edge 54. The shaving head frame 5 is also continuously held by the latch element 2 and 3 at the basic apparatus 1. Further, the projections 32 and 33 provided at the shutter are not yet positively coupled with the projections 30 and 31 at the slides 17 and 18. In the position of the shutter 6 shown in FIG. 6, in this case, for example, the apertured shear foil and the shaving head frame 5 have already been exposed by the shutter 6, which, however, would not yet be absolutely necessary and could be effected also during the process of attaining following position of the shutter. When the shutter 6 is displaced again from the position shown in FIG. 6 in the direction towards the apertured shear foil, the shutter 6 is decoupled in an analogous manner from the switching slide 45 in that, when projections 52 and 53 snapped into the notches 55 and 56 provided at the edge 54 or when the switching slide 45, is held by a further abutment not shown, the arm 61 of this slide being pivoted from the coupling member 63 provided at the shutter, this coupling member slides out of the depression 62 provided at the arm 61 and is thus disengaged from the switching slide 45.

Figure 7:
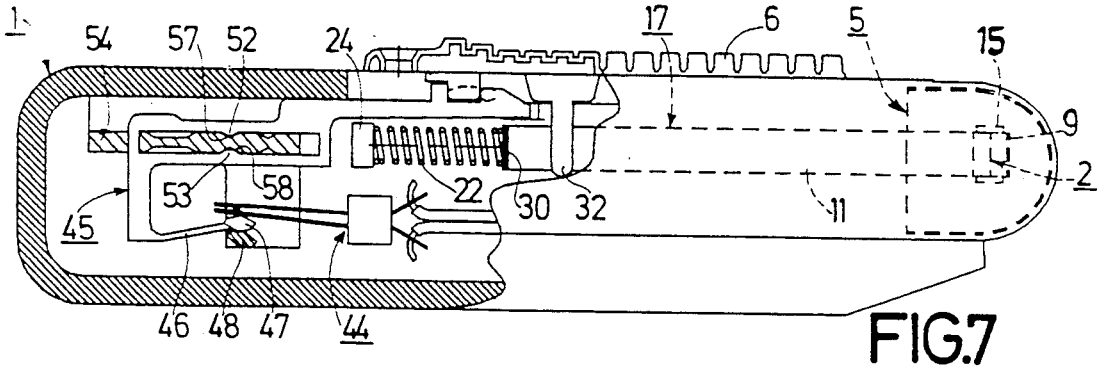

When the shutter 6 is displaced from the position shown in FIG. 6 further in the direction away from the apertured shear foil, it first reaches the position shown in FIG. 7, i.e. the switching-on position fixed by a latch. During this displacement, the shutter 6 now has taken along the switching slide 45, the projections 52 and 53 then having snapped into the notches 57 and 58 provided at the edge 54, as a result of which the switching-on position of the shutter 6 is fixed through the switching slide 45. During this displacement of the switching slide 45, the change-over switch 48 has displaced the switching cam 47 provided at the arm 46 of the switching slide 45 due to the cooperation of their ascending surfaces while pivoting the arm 46 towards the contact lamellae of the switch 44 and has caused them to engage each other, as a result of which the switch 44 and hence the motor current circuit for the drive of the dry shaving apparatus were closed. In this switching-on position of the shutter 6, in which the apertured shear foil and the shaving head frame 5 are exposed by it, the drive of the dry shaving apparatus is therefore effected and this apparatus is ready for shaving. As is apparent from FIG. 7, the projections 32 and 33 provided at the shutter 6 are still not yet positively coupled with the projections 30 and 31 provided at the slides 17 and 18. Therefore, the latch elements 2 and 3 connected to the slides 17 and 18 remain in their latched position, in which they hold the shaving head frame 5 at the basic apparatus 1.

Figure 8:
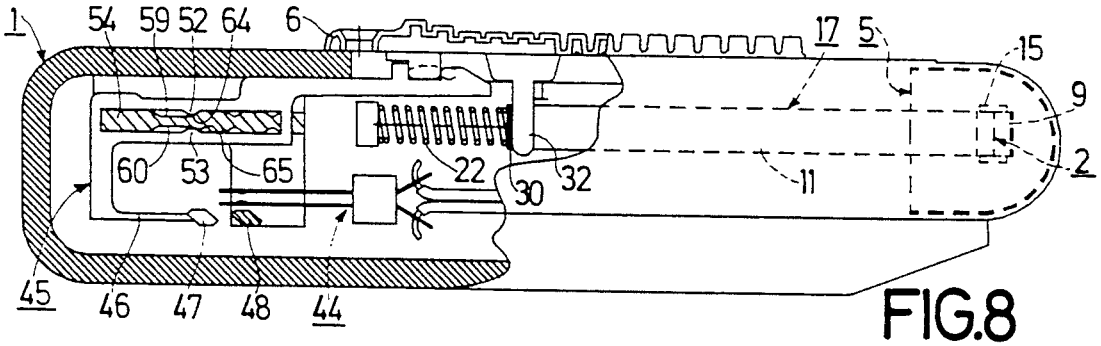

When the shutter 6 is displaced from the switching-on position further in the direction away from the apertured shear foil, in the present embodiment it first reaches an additional position shown in FIG. 8, which is fixed by a further latch, but in which the motor current circuit is interrupted again, which is effected in that the switching cam 47 slides downwards during the displacement of the switching slide 45 from the change-over switch 48, as a result of which the contact lamellae of the switch 44 are disengaged and hence the switch 44 is opened. When this additional position of the shutter 6 is reached, however, the projections 32 and 33 provided at it have approached so closely the projections 30 and 31 provided at the slides 17 and 18 that they are located with only a small amount of clearance or at a small distance immediately before the projections 30 and 31 so that the positive coupling of the shutter 6 with the slides 17 and 18 is already conditioned or essentially has already been established. Further, in this additional position of the shutter 6, the projections 52 and 53 provided at the switching slide 45 have now reached the elongate depressions 59 and 60 provided at the edge 54, these projections being located immediately beside the lateral limitation walls of the elongate depressions 59 and 60 constituting the abutments 64 and 65 and facing the apertured shear foil and thus engaging the ends of the elongate depressions 59 and 60 facing the apertured shear foil, as can be seen in FIG. 8. Due to these measures, for this additional position of the shutter a further latch fixing this position is formed, which effectively is bipartite, i.e. a latch half for each of the two directions of displacement of the shutter. In the direction of displacement of the shutter away from the apertured shear foil, the latch is constituted by the slides 17 and 18 subjected to the action of the springs 22 and 23 in that their projections 30 and 31 are located immediately before the projections 32 and 33 provided at the shutter. In the direction of displacement of the shutter towards the apertured shear foil, on the contrary, the latch is constituted by the limitation walls of the elongate depressions 59 and 60 arranged immediately before the projections 52 and 53 provided at the switching slide 45 and constituting abutments 64 and 65. Thus, the additional position of the shutter is fixed for both directions of displacement of the shutter because in both directions of displacement a resistance must be overcome, i.e. on the one hand the springs 22 and 23 and on the other hand the abutments 64 and 65, in order to move the shutter out of the additional position. Also in this additional position of the shutter 6, the shaving head frame 5 is held by the latch elements 2 and 3 at the basic apparatus 1 because the slides 17 and 18 were not yet displaced.

Figure 9:
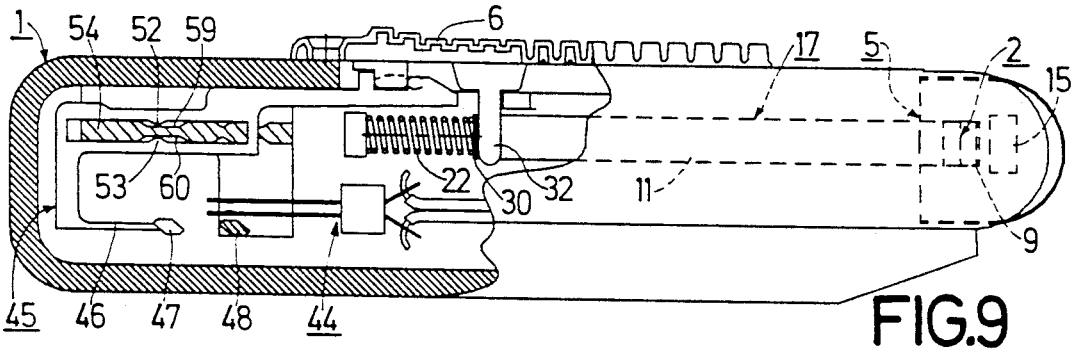

When the shutter 6 is displaced from the said additional position further away from the apertured shear foil, it reaches the further position shown in FIG. 9, which is not fixed by a latch because the projections 52 and 53 provided at the switching slide 45 now move freely at the area of the elongate depressions 59 and 60 provided at the edge 54 so that the shutter must be held by hand in this further position. During this further displacement of the shutter 6, the complete positive coupling of the projections 32 and 33 provided at the shutter with the projections 30 and 31 provided at the slides 17 and 18 is now established and hence the slides 17 and 18 are taken along in the direction away from the apertured foil, which results in a displacement of the latch elements 2 and 3 from their latched position, as a result of which the shaving head frame 5 already exposed by the shutter is now disengaged by the latch elements 2 and 3 in the manner described with reference to FIG. 3 and thus can be removed by hand from the basic apparatus 1, as is indicated in FIG. 9.

Figure 10:
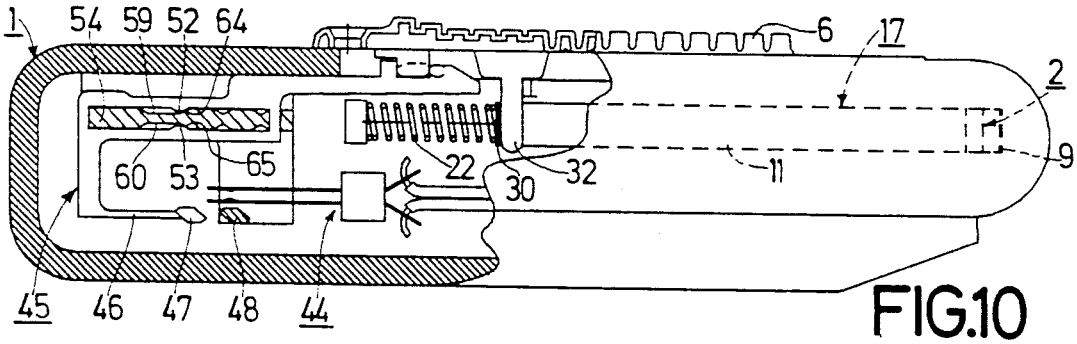

When the shutter 6 is released in this further position, in which it is held by hand, it immediately returns to the additional position, as is shown in FIG. 10 corresponding in this respect to FIG. 8. This is effected under the action of the springs 22 and 23, which attempt to pass the latch elements 2 and 3 again to their latched position, which is effected by a displacement of the slides 17 and 18 towards the apertured shear foil, until the latch elements 2 and 3 in fact have reached their latched position. The shutter 6 is then taken along by the projections 30 and 31 provided at the slides 17 and 18 through the projections 32 and 33 provided at this shutter due to the positive coupling between these projections, it taking along in turn the switching slide 45 coupled with it. In this additional position of the shutter 6, in which the latch described with reference to FIG. 8 is again operative, the shaving head frame 5 can then be placed again on the basic apparatus 1 in that it is simply caused to snap into the latch elements 2 and 3.

Figure 11:
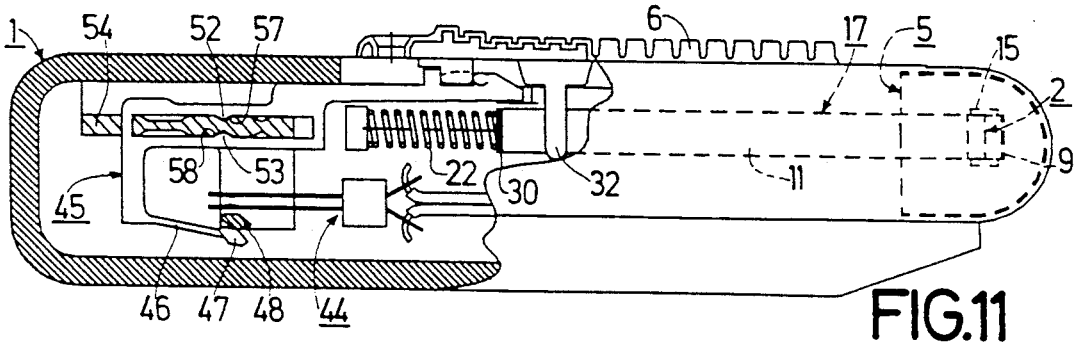

When the shutter 6 is brought by displacement by hand towards the apertured shear foil from the additional position again into the switching-on position, as shown in FIG. 11, the switching cam 47 arranged at the arm 46 of the switching slide 45 is now displaced by the change-over switch 48 due to the now oppositely orientated cooperating ascending surfaces in the direction away from the contact lamellae of the switch 44, as a result of which the switch 44 remains opened and hence the motor current circuit for the drive of the dry shaving apparatus remains interrupted. This interruption of the motor current circuit is maintained until the shutter, after having been displaced in the direction towards the apertured shear foil beyond the switching-on position, for example to the position shown in FIG. 6, is displaced again in the direction away from the apertured shear foil into the switching-on position because it is not until then that the switching cam 47 is again located in such a position before the change-over switch 48 that it is able to displace the switching cam 47 again in the direction towards the contact lamellae of the switch 44, so that it reaches a position as shown in FIG. 6. Due to such a measure, it is ensured that, when the shaving head frame is removed from the basic apparatus, the drive for the dry shaving apparatus cannot unintentionally be switched on. Since in the position of the shutter shown in FIG. 11 the latch elements 2 and 3 are also in their latched position, the shaving head frame 5 could also first be placed in this position on the basic apparatus 1, in case, for example, in the position shown in FIG. 10 this would be forgotten, which also applies to the next position following FIG. 11 and again corresponding to FIG. 6.

It should be noted that there are various possibilities of constructing such a change-over switch according to the known prior art. For example, such a change-over switch could also consist of a switching arm, which actuates the switch and which is rigid in one direction of movement and is elastically resilient in the opposite direction of movement. Further, also various constructive embodiments according to the prior art are of course possible for the construction of the latches fixing the various positions of the shutter. As is apparent, in the present embodiment the shutter 6 is fixed by latches in its switching-on position and in its additional position in that these latches cooperate with the switching slide 45, which in the relevant positions is coupled with the shutter, as a result of which a position latching is obtained for both parts, i.e. also for the shutter. As a matter of course, however, it is also possible for the latches to cooperate immediately with the shutter.

Figure 12:
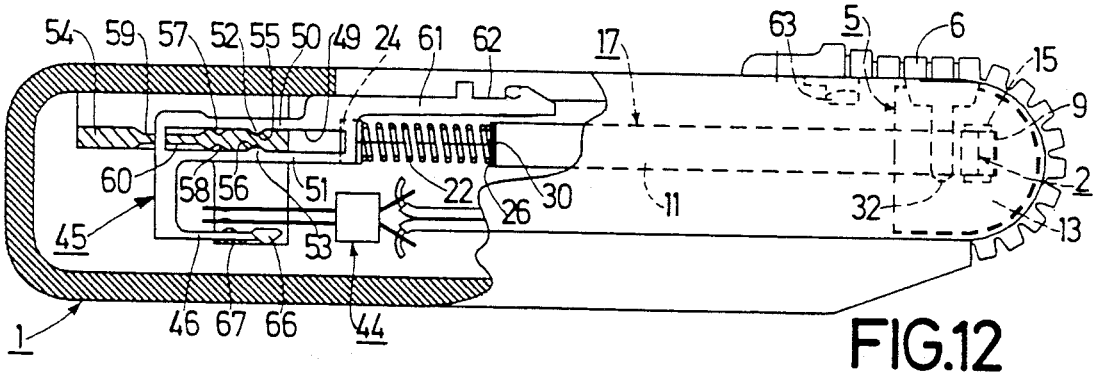
FIGS. 12 to 19 show in the manner of representation of FIGS. 4 to 11 a modification of the embodiment of FIGS. 4 to 11, in which again the shutter is in different positions.
Figure 13:
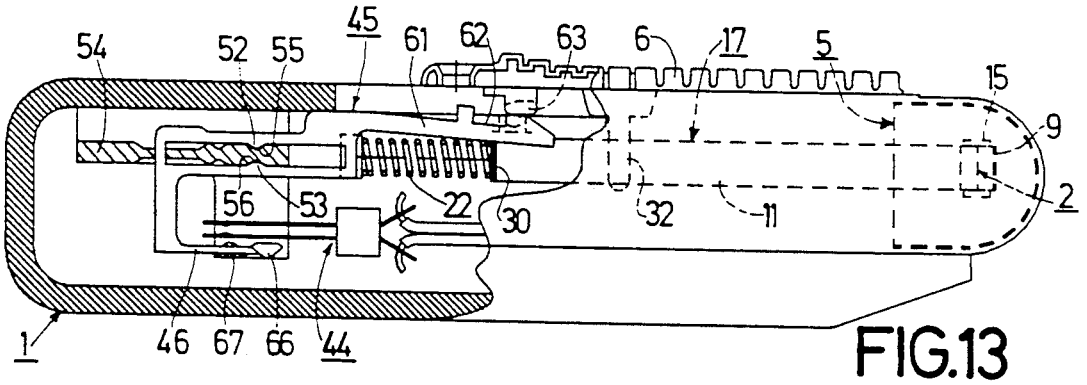
Figure 14:
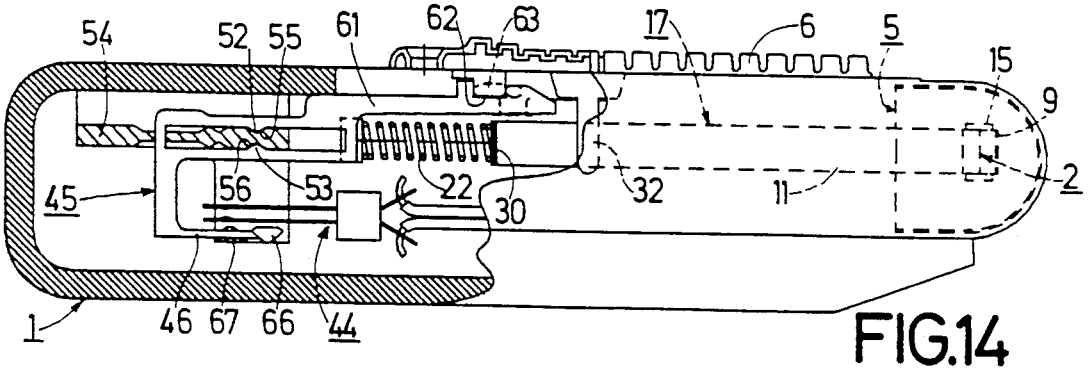

In the embodiment shown in FIGS. 12 to 19, FIG. 12 again shows the position of the shutter 6, in which it entirely covers the apertured shear foil. Upon displacement of the shutter 6 in the direction away from the apertured shear foil, the latter again reaches a position in which the coupling member 63 provided at the shutter starts snapping into the free end of the arm 61 of the switching slide 45, as is shown in FIG. 13. Upon a further displacement of the shutter away from the apertured shear foil, the coupling member 63 provided at the shutter snaps into the depression 62 at the arm 61 of the switching slide 45, as a result of which the shutter is coupled with the switching slide, as is shown in FIG. 14. In these three positions of the shutter, which are shown in FIGS. 12, 13 and 14, again the motor current circuit for the drive of the dry shaving apparatus is interrupted by the switch 44 because the switching cam 66, which is provided at the arm 46 of the switching slide 45 and is triangular in this case, is disengaged from the contact lamellae of the switch 44. Further, in these three positions of the shutter, the shaving head frame 5 is held at the basic apparatus 1 by the latch elements 2 and 3 situated in their latched position.

Figure 15:
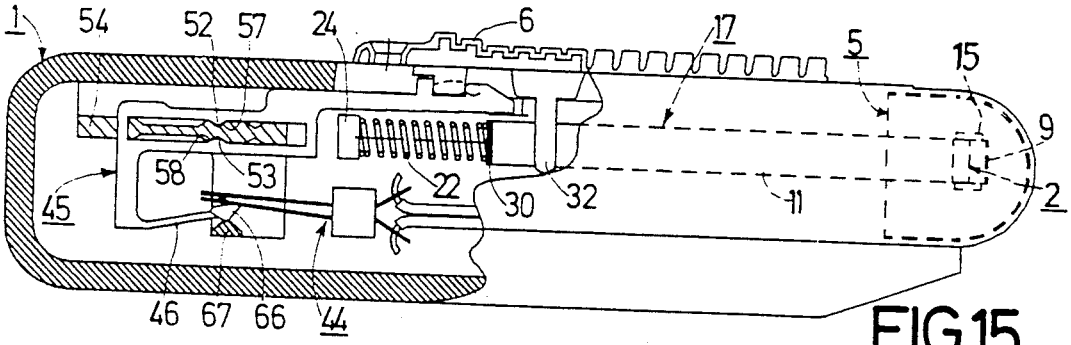

Upon further displacement of the shutter 6 in the direction away from the apertured shear foil, the latter again reaches the switching-on position, which is shown in FIG. 15. This switching-on position of the shutter is again fixed by a latch in that the projections 52 and 53 formed at the switching slide 45 at the area of the slot 49 provided therein are snapped into the notches 57 and 58 provided in the edge 54. Further, in this switching-on position, the motor current circuit for the drive of the dry shaving apparatus is closed again in that the switching cam 66 was displaced by a triangular guide element 67 arranged in the path of displacement of the switching cam 66 towards the contact lamellae of the switch 44, as a result of which it has brought them into contact with each other. In this switching-on position of the shutter 6, in which the apertured shear foil is exposed by it, the dry shaving apparatus is thus ready for shaving. As appears from FIG. 15, in this switching-on position of the shutter the latter is not yet positively coupled with the slides 17 and 18 carrying the latch elements 2 and 3 because the projections 32 and 33 provided at the shutter are still at a certain distance from the projections 30 and 31 provided at the slides 17 and 18.

Figure 16:
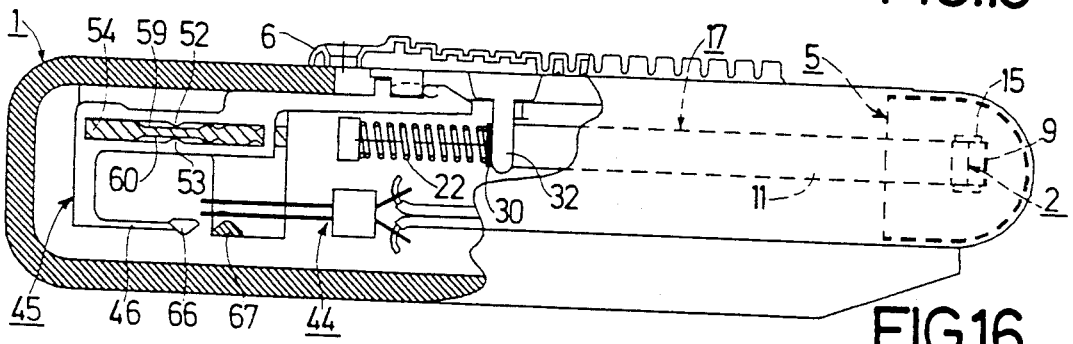
Figure 17:
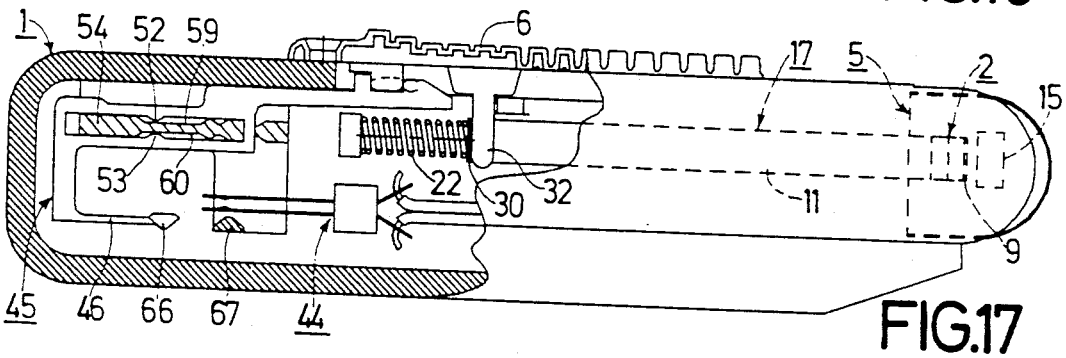

Upon further displacement of the shutter 6 in the direction away from the apertured shear foil, the shutter leaves the switching-on position, the switching cam 66 then first of all slides downwards from the guide element 67, as a result of which the contact lamellae of the switch 44 are disengaged and thus the switch 44 is opened and hence the motor current circuit is interrupted, after which the shutter reaches a position in which it is positively coupled with the slides 17 and 18 in that the projections 32 and 33 provided at the shutter engage the projections 30 and 31 provided at the slides 17 and 18, as is shown in FIG. 16. In the present embodiment, in contrast with the embodiment shown in FIGS. 4 to 11, no pronounced additional position for the shutter fixed by a latch operative in both directions of displacement of the shutter is provided, but during the displacement of the shutter from the switching-on position in the direction away from the apertured shear foil only the moment of the positive coupling of the shutter with the slides 17 and 18 can be sensed by the user in that at this instant an increased force is required for the displacement of the shutter, due to the springs 22 and 23 acting upon the slides 17 and 18. The projections 52 and 53 provided at the switching slide 45 in this case reach, immediately after they have left the notches 57 and 58 provided at the edge 54, the elongate depressions 59 and 60, which are made longer here, which extend more closely to the notches 57 and 58 and in which they can move freely. When the shutter 6 is displaced beyond the position shown in FIG. 16 further in the direction away from the apertured shear foil, it takes along the slides 17 and 18 due to the positive coupling with the latter, as a result of which the latch elements 2 and 3 are moved out of their latched position and they thus disengage the shaving head frame 5 already exposed by the shutter 6, as is shown in FIG. 17. In the further position of the shutter thus reached, in which it is held again by hand, the shaving head frame 5 can then be removed by hand from the basic apparatus 1.

Figure 18:
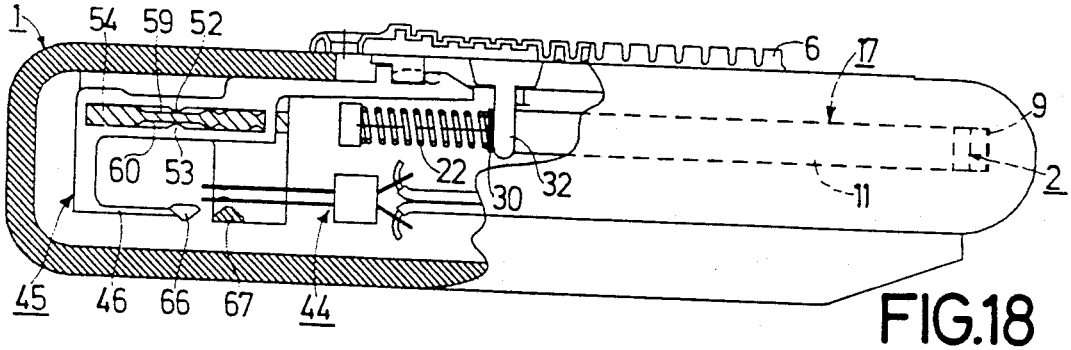
Figure 19:
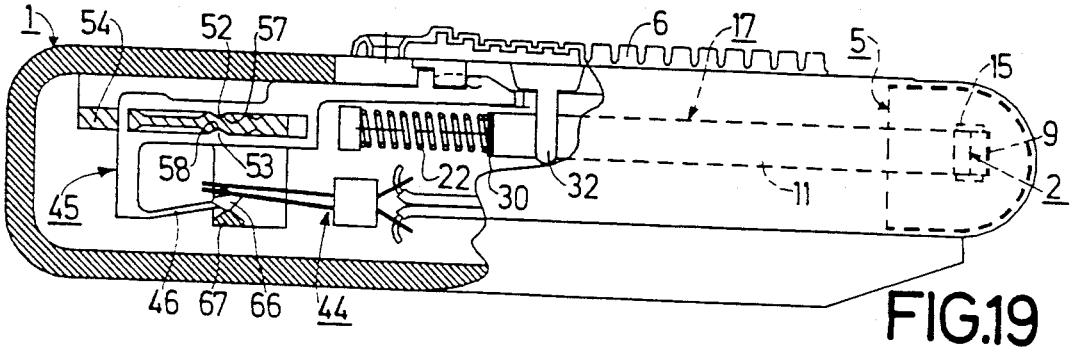

As soon as the shutter 6 held in the further position is released, it automatically returns to the position shown in FIG. 18 corresponding to the position shown in FIG. 16, in which it then remains. This is effected again under the action of the springs 22 and 23, which displace the slides 17 and 18 in the direction towards the apertured shear foil, as a result of which the latch elements 2 and 3 connected to them are passed again to their latched position, the shutter being taken along due to the existing positive coupling with the slides 17 and 18 until these slides have reached their final position and hence the latch elements 2 and 3 have reached their latched position. In this position of the shutter, the shaving head frame 5 removed from the basic apparatus 1 can then be placed again on the basic apparatus 1, it then snapping into the latch elements 2 and 3 situated in their latched position and being held by the latter at the basic apparatus 1. When subsequently the shutter is brought again into the switching-on position, which is effected by displacement by hand of the shutter in the direction towards the apertured shear foil, in the present embodiment the motor current circuit is immediately closed again because in this case the switching cam 66 is displaced again by the guide element 67 towards the contact lamellae of the switch 44 so that the dry shaving apparatus is again ready for shaving, as is shown in FIG. 19 corresponding to FIG. 15.

As appears from the foregoing, a series of variations of the various illustrative embodiments are possible without departing from the scope of the invention. This especially applies, among other things to the kind of the latches to be provided for various positions of the shutter, to the construction of the slides and the latch elements connected to them for holding the shaving head frame at the basic apparatus and the positive coupling of the shutter with the slides carrying the latch elements.

We claim:

1. A dry shaving apparatus comprising a shaving head frame detachably held to the basic apparatus by at least one resilient latch element and carrying an apertured shear foil and a slidable shutter, which serves to optionally cover or expose the apertured shear foil and, when displaced in the direction away from the apertured shear foil is actuated and lock by a latch to switch on a motor in which position the apertured shear foil is exposed for shaving which upon further displacement in the direction away from the apertured shear foil, the shaving head frame is exposed by the shutter and the motor is switch off with the switch locked in that position by the latch, characterized in that the latch cooperating with the shaving head frame is connected to a slide, which is displaceable parallel to the direction of displacement of the shutter and cooperates with a spring, and that the shutter, where it is displaced from the switching-on position into the further displacement, is positively coupled with the slide and the slide can be taken along against the action of the spring cooperating with it by the shutter, the latch elements being moved out of the latched position holding the shaving head frame and the shaving head frame being disengaged.

2. A dry shaving apparatus as claimed in claim 1, wherein the slide is constituted by a blade spring.

3. A dry shaving apparatus as claimed in claim 2, wherein the blade spring has at its end facing the shaving head frame a rectangularly bent hook-shaped part, which constitutes the latch element,

4. A dry shaving apparatus as claimed in claim 3, wherein the further position of the shutter is unfixed, the shutter being displaceable from the further position together with the slide under the action of the spring cooperating with the slide in the direction towards the apertured shear foil until it reaches the latched position of the latch element connected to the slide, and wherein upon a further displacement of the shutter towards the apertured shear foil by means of a change-over switch the motor current circuit for the drive of the dry shaving apparatus remains interrupted until the shutter, after a displacement beyond the switching-on position, is again displaced in the direction away from the apertured shear foil into the switching-on position.

5. A dry shaving apparatus as claimed in claim 3, wherein between the outer side of the shaving head frame and the basic apparatus at least one straight line guiding is provided defining the direction of removal of the shaving head frame from the basic apparatus.

6. A dry shaving apparatus as claimed in claim 3, wherein the apertured shear foil cooperates with a lower blade, which is arranged at the basic apparatus and is resiliently pressed against the apertured shear foil, wherein between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade.

7. A dry shaving apparatus as claimed in claim 2, wherein the further position of the shutter is unfixed, the shutter being displaceable from the further position together with the slide under the action of the spring cooperating with the slide in the direction towards the apertured shear foil until it reaches the latched position of the latch element connected to the slide, and wherein upon a further displacement of the shutter towards the apertured shear foil by means of a change-over switch a motor current circuit for the drive of the dry shaving apparatus remains interrupted until the shutter, after a displacement beyond the switching-on position, is again displaced in the direction away from the apertured shear foil into the switching-on position.

8. A dry shaving apparatus as claimed in claim 2, wherein between the outer side of the shaving head frame and the basic apparatus at least one straight line guiding is provided defining the direction of removal of the shaving head frame from the basic apparatus.

9. A dry shaving apparatus as claimed in claim 2, wherein the apertured shear foil cooperates with a lower blade, which is arranged at the basic apparatus and is resiliently pressed against the apertured shear foil, wherein between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade. wherein the blade spring has at its end facing the shaving head frame a rectangularly bent hook-shaped part, which constitutes the latch element.

10. A dry shaving apparatus as claimed in claim 1 wherein the further position of the shutter is unfixed, the shutter being displaceable from the further position together with the slide under the action of the spring cooperating with the slide in the direction towards the apertured shear foil until it reaches the latched position of the latch element connected to the slide, and wherein upon a further displacement of the shutter towards the apertured shear foil by means of a change-over switch a motor current circuit for the drive of the dry shaving apparatus remains interrupted until the shutter, after a displacement beyond the switching-on position, is again displaced in the direction away from the apertured shear foil into the switching-on position.

11. A dry shaving apparatus as claimed in claim 10, wherein between the switching-on position fixed by a latch and the unfixed further position of the shutter is provided an additional position for the shutter, which is fixed by a further latch and in which the apertured shear foil and the shaving head frame is exposed by the shutter and the motor current circuit for the drive of the dry shaving apparatus is interrupted, and wherein the further latch is constituted on the one hand, viewed in the direction of displacement of the shutter away from the apertured shear foil, by the slide subjected to the action of the spring when the latch element is in the latched position and on the other hand, viewed in the direction of displacement of the shutter towards the apertured shear foil, by at least one stationary abutment.

12. A dry shaving apparatus as claimed in 11, wherein between the outer side of the shaving head frame and the basic apparatus at least one straight line guiding is provided defining the direction of removal of the shaving head frame from the basic apparatus.

13. A dry shaving apparatus as claimed in claim 11, wherein the apertured shear foil cooperates with a lower blade, which is arranged at the basic apparatus and is resiliently pressed against the apertured shear foil, wherein between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade.

14. A dry shaving apparatus as claimed in claim 10, wherein between the outer side of the shaving head frame and the basic apparatus at least one straight line guiding is provided defining the direction of removal of the shaving head frame from the basic apparatus.

15. A dry shaving apparatus as claimed in claim 10, wherein the apertured shear foil cooperates with a lower blade, which is arranged at the basic apparatus and is resiliently pressed against the apertured shear foil, wherein between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade.

16. A dry shaving apparatus as claimed in claim 1 wherein between the outer side of the shaving head frame and the basic apparatus at least one straight line guiding is provided defining the direction of removal of the shaving head frame from the basic apparatus.

17. A dry shaving apparatus as claimed in claim 16 wherein the abutment stops are arranged at the area of the straight line guiding.

18. A dry shaving apparatus as claimed in claim 10, wherein the apertured shear foil cooperates with a lower blade, which is arranged at the basic apparatus and is resiliently pressed against the apertured shear foil, wherein between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade.

19. A dry shaving apparatus as claimed in claim 1, wherein the apertured shear foil cooperates with a lower blade, which is arranged at the basic apparatus and is resiliently pressed against the apertured shear foil, characterized in that between the shaving head frame and the basic apparatus elastically resilient abutment stops are provided, which cooperate with each other in the direction of removal of the shaving head frame from the basic apparatus and which limit, after the shaving head frame has been disengaged by the latch element, the movement of lifting the shaving head frame from the basic apparatus occurring under the action of the spring-loaded lower blade.

20. A dry shaving apparatus as claimed in claim 19, wherein the abutment stops are arranged at the area of the straight line guiding.

* * * * *